United States Patent [19]

Colangelo

[11] 4,395,592

[45] Jul. 26, 1983

[54] RIBBON LOUDSPEAKER

[75] Inventor: Thomas P. Colangelo, Hamden, Conn.

[73] Assignee: Mark Levinson Audio Systems Ltd., Middletown, Conn.

[21] Appl. No.: 241,401

[22] Filed: Mar. 6, 1981

[51] Int. Cl.[3] ..... H04R 7/02

[52] U.S. Cl. ..... 179/115 V; 179/115.5 DV; 179/115.5 ME; 179/181 R; 181/151

[58] Field of Search ..... 179/115 V, 115.5 DV, 179/115.5 ME, 181 R, 179, 180; 181/157, 151

[56] References Cited

U.S. PATENT DOCUMENTS

| | | | |
|---|---|---|---|
| 4,027,111 | 5/1977 | Kasatkin et al. | 179/115 V |
| 4,317,966 | 3/1982 | Lister | 179/115 V |
| 4,319,096 | 3/1982 | Winey | 179/115 V |

*Primary Examiner*—Benjamin R. Fuller
*Attorney, Agent, or Firm*—Robert H. Montgomery

[57] ABSTRACT

A ribbon loudspeaker is suitable for incorporation into a sound reproduction system without additionally requiring a transformer or series resistor. In one form in which the loudspeaker is bi-directional, a sound reproduction ribbon is received in a pair of magnetic gaps formed from a magnetic system employing a single magnet.

12 Claims, 10 Drawing Figures

RIBBON LOUDSPEAKER

BACKGROUND OF THE INVENTION

This invention relates to a loudspeaker employing a ribbon for sound reproduction. In particular, this invention relates to a loudspeaker which may be incorporated into a stereo system or other sound reproduction system.

Briefly, ribbon loudspeakers generally operate by means of vibrating an electrically conductive ribbon between opposite poles of a magnetic system. The sound to be reproduced in the form of electric impulses is applied to the ribbon. The interactions of the magnetic field produced by the electric current and the field of the magnetic system produce vibrations of the ribbon, and resulting sound radiation.

A number of ribbon loudspeakers in the patent literature are directed to improvements in the capacity and quality of sound reproduction. Some of the most recent advances in loudspeakers are directed to improvements in the ribbon and ribbon component. Examples of these latter advancements are provided by spacing the ribbon segments apart in a specific manner, constructing the cross-section of the ribbon to be of a certain non-uniform thickness, and constructing a plurality of sound reproduction ribbons between a plurality of permanent magnets.

A number of other loudspeaker advancements have been directed primarily to the design and positioning of the magnet, such as a disconnected plurality of permanent magnets constructed to form a magnetic system or various specifically shaped magnet structures.

The present invention represents an advancement over prior loudspeakers by virtue of the cooperation between a sound reproduction ribbon and a unique magnetic system design, which in one form results in a bi-directional speaker using a single common magnet structure.

SUMMARY OF THE INVENTION

This invention in one form comprises an elongated permanent magnet surrounded by two pole pieces which are structured to cooperate to form a pair of magnetic gaps. A ribbon for sound reproduction is wound in a continuous manner around the permanent magnet and received in each of the gaps. The ribbon may be wound to form a plurality of layers and may also be corrugated.

An object of this invention is to provide a new and improved loudspeaker.

Another object of this invention is to provide a new and improved loudspeaker which employs a common magnet structure to produce bi-directional sound radiation.

A further object of this invention is to provide a new and improved ribbon loudspeaker which may be incorporated into a sound reproduction system without requiring a matching transformer or series resistor.

A still further object of this invention is to provide a new and improved loudspeaker which is bi-directional and capable of improved sound reproduction quality.

Other objects and advantages will become apparent from the detailed description and accompanying drawings.

DETAILED DESCRIPTION

Figure 1:
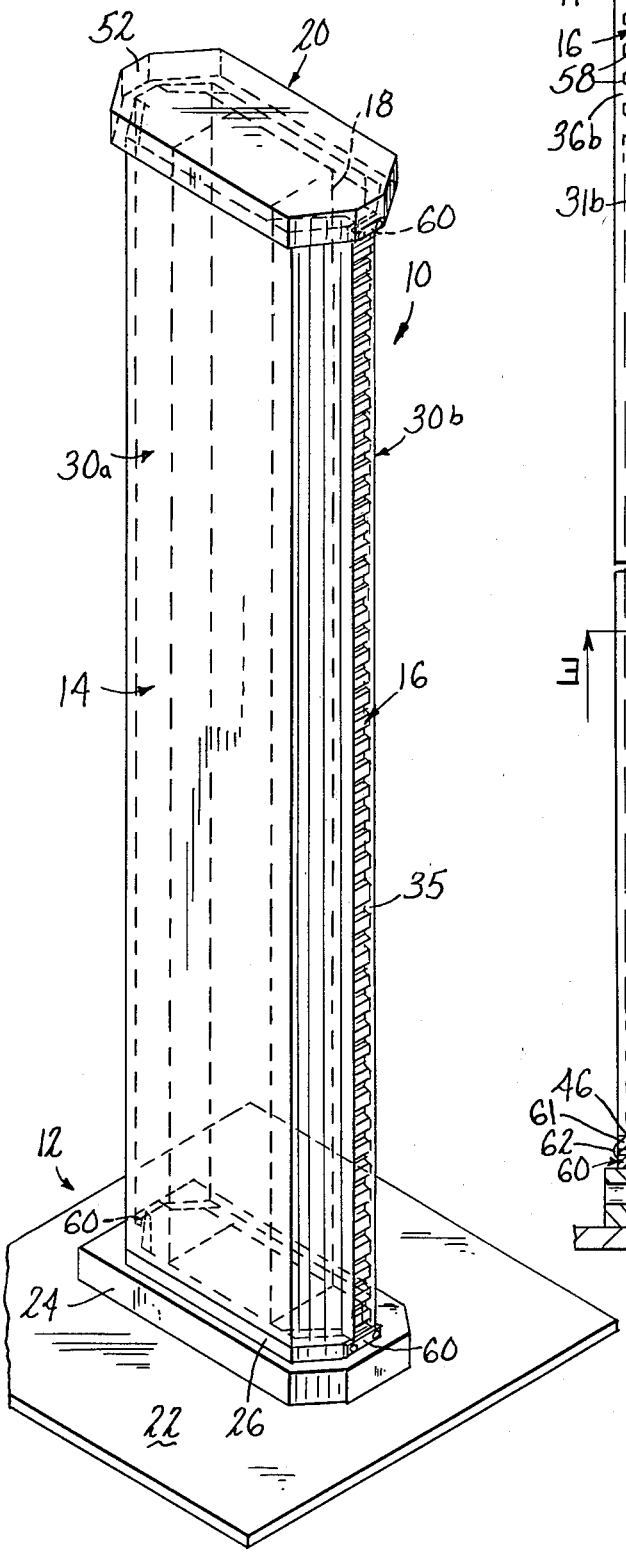
FIG. 1 is a perspective view of a preferred form of the loudspeaker.

With reference to FIG. 1, a loudspeaker shown generally as 10, comprises a base assembly 12 supporting a pole assembly 14. A ribbon shown generally as 16, is positioned to be exteriorly visible on opposing sides of the loudspeaker. A permanent magnet 18 (shown in dashed lines) positioned interior to the pole assembly 14 and ribbon 16, extends upwardly from base assembly 12. A cover assembly 20 encloses magnet 18.

Figure 2:
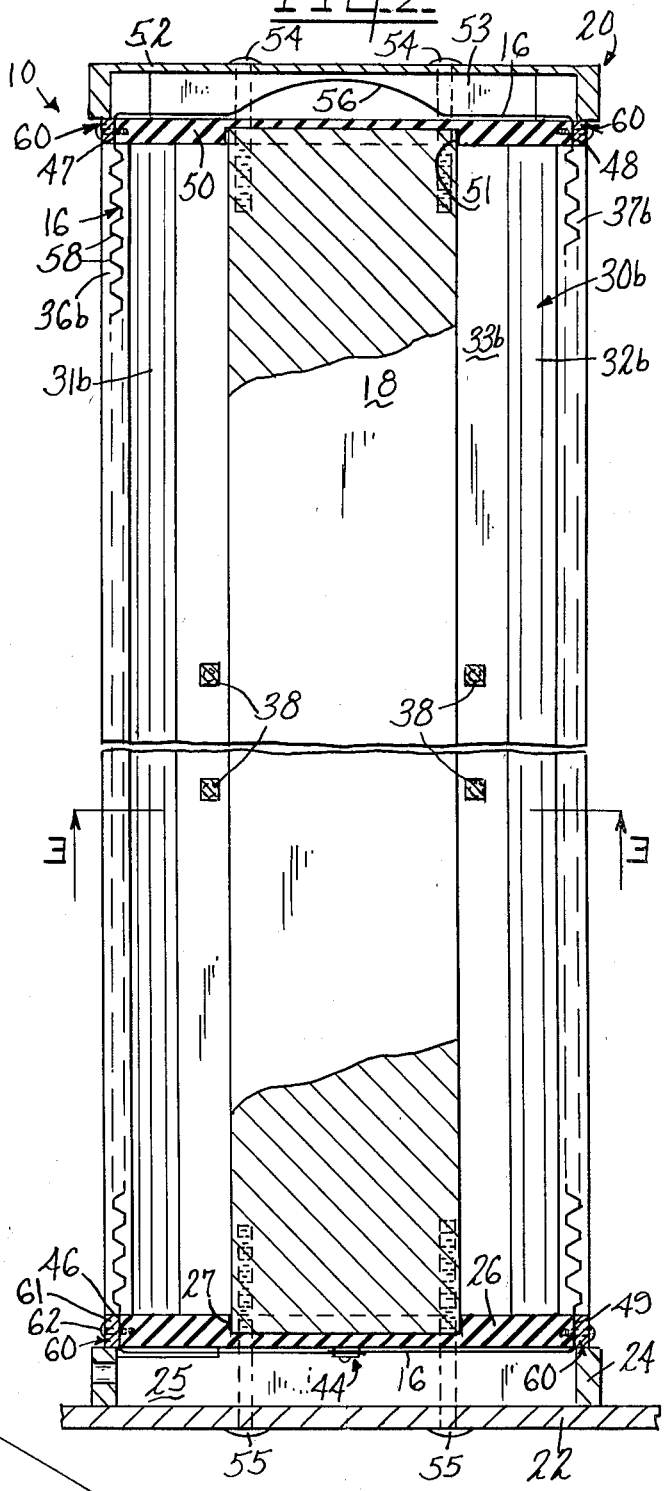
FIG. 2 is a side sectional view of the loudspeaker of FIG. 1.

Turning now to FIG. 2, base assembly 12 further comprises base 22 supporting a skirt 24 having a central recess 25. Mounted on the top of skirt 24 is bottom magnet cover 26. The upper portion of bottom magnet cover 26 is provided with a recess 27 which is adapted to receive magnet 18, as will be further described below. It is preferred that bottom magnet cover 26 be manufactured of a ceramic material such as bakelite or other material which is not electrically conductive or magnetically inductive.

Permanent magnet 18 which is made from barium ferrite, aluminium nickel alloy or other strongly magnetic material, is manufactured in an elongated shape, preferably rectilinear. Magnet 18 is positioned in an upright manner, as shown in FIG. 2, the bottom of magnet 18 being received in recess 27. It is preferable that the contours of the sides of recess 27 closely conform to the sides of the bottom of magnet 18. Magnet 18 may be of substantial weight necessitating a rigid support structure, particularly with respect to the base assembly 12.

Pole assembly 14 comprises substantially identical upright pole pieces **30*a* and 30*b* which essentially surround permanent magnet 18 along the entire vertical extent of magnet 18. Pole pieces 30*a* and 30*b*** are made of a metallic material of high magnetic inductance.

Figure 3:
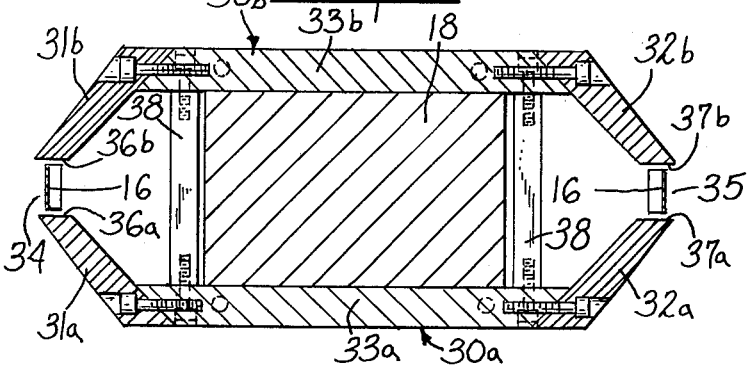
FIG. 3 is a sectional view along line 3—3 of FIG. 2.

With reference to FIG. 3, a cross-sectional view shows the pole pieces may be described as a truncated v-shaped configuration. While the pole pieces may be manufactured as a unitary structure, a preferred manufacturing mode for pole piece **30*a* as shown in FIG. 3, comprises a pair of gap panels 31*a* and 32*a* extending obliquely at each end of a vertical panel 33*a* and for pole piece 30*b*, a pair of gap panels 31*b* and 32*b* extending obliquely at each end of a vertical panel 33*b*. Pole pieces 30*a* and 30*b* cooperate to define a gap 34 between the ends 36*a* and 36*b* of gap panels 31*a* and 31*b* and a gap 35 between ends 37***a* and 37*b* of gap panels 32*a* and 32*b*, as shown in FIG. 3. Vertical panels 33*a* and 33*b* may contact against opposing sides of magnet 18. It is critical that the pole pieces be positioned so that permanent magnet 18 induces a magnetic field between ends 36*a* and 36*b* and between ends 37*a* and 37*b*. For purposes of illustration, structures denoted with the letter a represent structures of one magnetic polarity and structures denoted with the letter b denote structures of magnet polarity opposite to those denoted by a.

Gaps 34 and 35 extend in a vertical direction essentially parallel to magnet 18 and commensurate in length with the vertical height of magnet 18. Gaps 34 and 35 are preferably of uniform width and thickness.

Spacers 38 may be employed to reinforce the structure of the loudspeaker, and in particular, to secure the pole pieces in relative position. The gap panels may also be secured to the vertical panels. The pole piece components may be secured to the base assembly and the cover assembly as described below.

Figure 4:
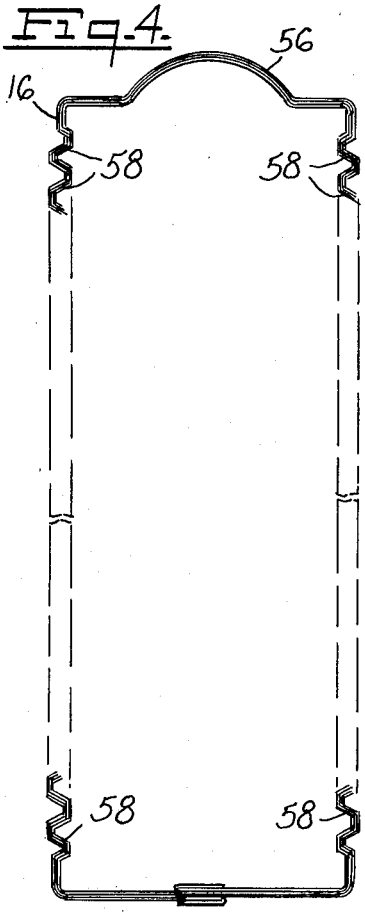
FIG. 4 is a side elevational view of the ribbon of the loudspeaker of FIG. 2, partly broken away.

Ribbon 16 commprises a layer 40 which is an electrical conductor and a layer 41 which is an electrical insulator. The layers are placed one on top of the other and bonded together in a continuous manner. Layer 40 may be composed of aluminum foil and layer 41 may be composed of mylar or a polyester material. Ribbon 16 is wound in a continuous manner commencing at ribbon clamp 44 affixed to the bottom of bottom magnet cover 26. Ribbon clamp 44 is described in detail below. Ribbon 16 continues past bottom cover edge 46, extends vertically through gap 34 to top cover edge 47, continues past top cover edge 48, extends vertically through gap 35 past bottom cover edge 49, and continues back through clamp 44. This latter described cycle may be repeated a plurality of times resulting in a plurality of layers as illustrated in FIG. 4. It is noted that successive layers 40 are electrically insulated from each other by means of layers 41.

Reference is made to the relationship between the top of ribbon 16 and cover assembly 20. Cover assembly 20 comprises a top magnet cover 50 having a recess 51 which receives the top of magnet 18. Cover 50 is preferably made of the same materials and in substantially the same shape as magnet bottom cover 26. Cover plate 52 having a substantial central recess 53 is mounted on top of cover 50. Recess 53 receives the top portion of ribbon 16.

A suitable means for securing the foregoing described loudspeaker components can be provided at the top of the loudspeaker, by bolts 54 which extend through cover 50 and cover plate 52 into pole pieces 30*a* and 30*b*. Similarly at the bottom, bolts 55 extend through base 22 and bottom cover 26 into pole pieces 30*a* and 30*b*.

With further reference to FIGS. 2 and 4, ribbon 16 may be secured in position by means of support clamps 60 positioned at edges 46, 47, 48 and 49. Support clamp 60 comprises an electric insulating non-magnetic plate 61 which can be tightened against ribbon 16 by means of adjustment screws 62. The orientation of edges 46 and 47 with respect to gap 34 and edges 48 and 49 with respect to gap 35 acts to align the ribbon 16 in the gaps. It is preferable that ribbon 16 be positioned proximate the center of the gaps, as shown in FIG. 3. The clearance distance between the edges of ribbon 16 and gap ends 36*a*, 36*b* and 37*a* and 37*b* should be relatively small.

The tightness of the ribbon in gaps 34 and 35 can be adjusted by means of support clamps 60. Tightening of the ribbon in the gaps may result in a slight slackening of the ribbon at the top and the slackening may be embodied in a configuration such as a loop 56 situated in recess 53. It is preferred that the portion of the ribbon which is situated in gaps 34 and 35 be corrugated into a plurality of accordion-like folds 58 extending in a direction perpendicular to the vertical orientation of the ribbon.

Figure 5:
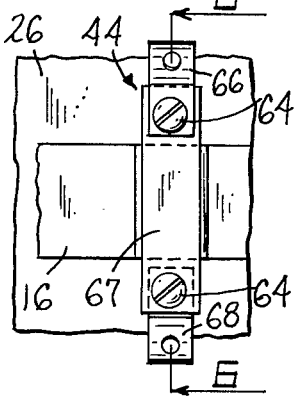
FIG. 5 is a bottom view of a ribbon clamp assembly of the loudspeaker of FIG. 2.
Figure 6:
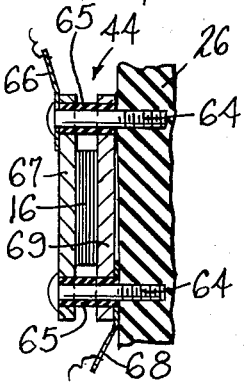
FIG. 6 is a sectional view along the line 6—6 of FIG. 5.
Figure 7:
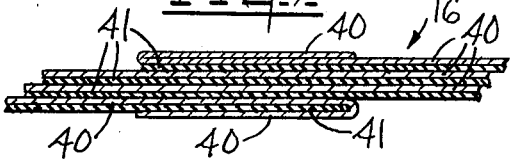
FIG. 7 is an enlarged side sectional view of a portion of the ribbon of FIG. 4.

With reference to FIGS. 5 and 6, ribbon clamp 44 is centrally positioned on the bottom of bottom magnet cover 26 in recess 25. Clamp 44 comprises contact plates 67 and 69 which are forced against opposing sides of ribbon 16 by tightening screws 64. Washers 65 insulate screws 64 from contact plates 67 and 69 which are electrically conductive and conductively communicate with electrical contacts 66 and 68, respectively. The ribbon is wound so that it commences and terminates proximate the ribbon clamp 44. As previously described, ribbon 16 comprises a layer 40 of an electrical conductor and a layer 41 of an electrical insulator. The conductive layer 40 extends beyond the insulating layer 41 as shown in FIG. 7. The extended portion is folded over so that both sides of the ribbon at the vicinity of ribbon clamp 44 are essentially conductive layers and hence form an electrical contact at plates 67 and 69.

In operation, the sound to be reproduced assumes the form of electrical impulses which are applied to electrical contacts 66 and 68, which in turn communicate with the conductive layer 40. Conductive layer 40 may be wound a plurality of times to form a plurality of layers. Because the input impedance of the loudspeaker is a direct function of the length of the conductive material in the ribbon, it is readily apparent that the input impedance can be suitably fixed by design choice in the length of the ribbon or number of layers. Because the loudspeaker can be designed with a relatively high input impedance, the loudspeaker can be made to match existing amplifiers without the use of a matching transformer or series resistor.

Magnet 18 magnetically induces pole pieces 30*a* and 30*b* so that opposing ends 36*a* and 36*b* and 37*a* and 37*b* are of opposing magnetic polarity. Magnetic lines of force therefore traverse gap 34 defined between ends 36*a* and 36*b* and gap 35 defined between ends 37*a* and 37*b*.

The passage of electrical current through ribbon 16 positioned in magnetic gaps 34 and 35 produces a vibration of the ribbon and the consequent reproduction of sound due to the magnetic attractions and repulsions resulting from the interaction of the lines of magnetic force produced by the current and the lines of magnetic force in the gaps. It is noted that a common magnetic structure essentially produces bi-directional radiation. The sound radiation is in phase and consequently the loudspeaker provides a system where the effective radiating area is substantially twice the effective radiating area produced by a conventional magnetic structure of similar size. The corrugations or folds 58 provide for efficient movement of the ribbon from side to side in the magnetic gap.

Figure 10:
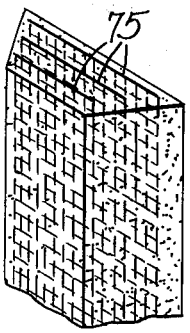
FIG. 10 is a perspective view of a wire mesh which may be employed in the loudspeaker.
Figure 8:
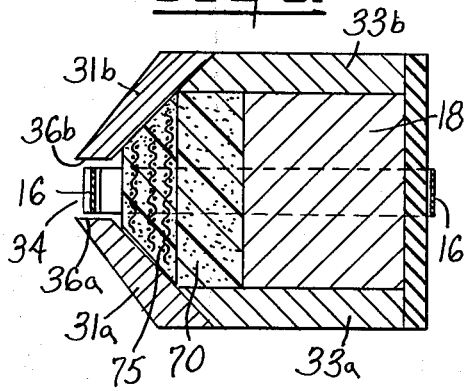
FIG. 8 is a top sectional view of an alternate form of the loudspeaker employing a single gap.

With reference to FIG. 8, a sound absorbing material 70 may be inserted to fill the spaces between the magnet 18 and pole pieces 30*a* and 30*b*. A wire mesh 75, as illustrated in FIG. 10, may also be inserted into the interior spaces defined by magnet 18 and pole pieces 30*a* and 30*b*. Wire mesh 75 may be grounded to the pole pieces. The function of wire mesh 75 and sound absorbing material 70 is to absorb and remove the stray magnetic flux and sound produced and reflected in the region between the pole pieces and the magnet, and to therefore minimize distortion.

Figure 9:
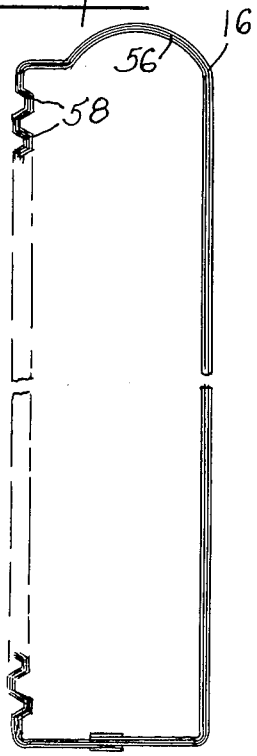
FIG. 9 is a side elevational view of the ribbon of the loudspeaker of FIG. 8, partly broken away.

With further reference to FIG. 8 and FIG. 9, the invention may employ a single magnetic gap 34, in which case the physical structure of the speaker may be viewed as similar to the structure previously described, but halved along a vertical surface midway between the gaps. This embodiment would essentially be a unidirectional loudspeaker with the ribbon assuming a configuration as shown in FIG. 9, in which the vertical portion opposite the gap is positioned to extend along the side of the permanent magnet opposite gap 34.

It may thus be seen that the objects of the invention set forth, as well as those made apparent from the foregoing description, are efficiently attained. While preferred embodiments of the invention have been set forth for purposes of disclosure, modifications of the disclosed embodiments of the invention as well as other embodiments thereof, may occur to those skilled in the art. Accordingly, the appended claims are intended to cover all embodiments of the invention which do not depart from the spirit and scope of the invention.

What I claim is:

1. A ribbon loudspeaker comprising:

an elongated permanent magnet of substantially rectilinear structure having two pairs of opposite faces;

a pair of pole pieces, each contacting against opposite faces and extending outwardly from said faces to form a pair of magnetic gaps, said gaps being parallel to and spaced apart from said second pair of faces and extending the length of said faces; and a ribbon for sound reproduction continuously wound around said magnet and received in and extending the length of said gaps.

2. The loudspeaker of claim 1 wherein said ribbon is wound to form a plurality of layers.

3. The loudspeaker of claim 1 wherein each of said pole pieces comprises a structure having a truncated v-shaped cross-section.

4. The loudspeaker of claim 3 wherein said pole pieces are substantially identical and parallel and are positioned to open toward each other, the outer ends of said pieces defining said gaps.

5. The loudspeaker of claim 4 wherein said magnet is positioned between said pole pieces.

6. The loudspeaker of claim 4 further comprising means to minimize distortion positioned between said pole pieces.

7. The loudspeaker of claim 1 wherein the ribbon is corrugated.

8. The loudspeaker of claim 1 further comprising means for adjusting the tightness of said ribbon.

9. The loudspeaker of claim 1 wherein said ribbon comprises a layer which is an electrical conductor and a layer which is an electrical insulator.

10. The loudspeaker of claim 9 wherein said conductor is aluminum foil and said insulator is mylar.

11. The loudspeaker of claim 1 wherein said gaps are of uniform width and thickness, said ribbon is of a uniform width slightly less than the width of said gaps, and said ribbon is centrally positioned in said gaps.

12. The loudspeaker of claim 1 wherein the portions of ribbon positioned in said gaps comprise a plurality of corrugations perpendicular to the longitudinal dimension of said ribbon.

* * * * *